US008714384B2

(12) United States Patent
Aneas

(10) Patent No.: US 8,714,384 B2
(45) Date of Patent: May 6, 2014

(54) DEVICE FOR STOPPING A CONTAINER, AND CONTAINER PROVIDED WITH SUCH A DEVICE

(75) Inventor: Antoine Aneas, Menetrol (FR)

(73) Assignee: West Pharmaceutical Services Deutschland GmbH & Co. KG, Eschweiler (DE)

( * ) Notice: Subject to any disclaimer, the term of this patent is extended or adjusted under 35 U.S.C. 154(b) by 0 days.

(21) Appl. No.: 13/883,465

(22) PCT Filed: Nov. 22, 2011

(86) PCT No.: PCT/EP2011/070609

§ 371 (c)(1), (2), (4) Date: May 24, 2013

(87) PCT Pub. No.: WO2012/069436

PCT Pub. Date: May 31, 2012

(65) Prior Publication Data

US 2013/0233822 A1 Sep. 12, 2013

(30) Foreign Application Priority Data

Nov. 24, 2010 (FR) ..... 1059683

(51) Int. Cl.
*B65D 39/00* (2006.01)

(52) U.S. Cl.
USPC ..... 215/364; 215/247; 220/801

(58) Field of Classification Search
USPC ..... 53/264, 485; 604/415, 905; 220/315, 220/800, 801; 215/40, 50, 54, 204, 209, 215/216, 224, 247, 249, 263, 272, 273, 274, 215/275, 277, 279, 280, 282, 289, 290, 293, 215/296, 317, 320, 321, 322, 355
See application file for complete search history.

(56) References Cited

FOREIGN PATENT DOCUMENTS

FR 2927316 A1 8/2009

OTHER PUBLICATIONS

Int'l Preliminary Report on Patentability issued Jun. 6, 2013 in Int'l Application No. PCT/EP2011/070609.
Int'l Search Report dated Dec. 12, 2011 in Int'l Application No. PCT/EP2011/070609.

*Primary Examiner* — Jacob K Ackun
*Assistant Examiner* — Allan Stevens
(74) *Attorney, Agent, or Firm* — Panitch Schwarze Belisario & Nadel LLP

(57) ABSTRACT

The invention relates to a device for stopping a container (1) having a neck (12). The device includes a stopper (51) and a plastic cap (52) configured to surround both the stopper (51) and the neck (12). The cap (52) includes a ring (53) that can surround the stopper and the neck when mounted and is provided with a locking tab (537) for locking onto the neck, and a body (54) for handling the ring, provided with an external rib (535) for transmitting a thrust force to the ring and an edge (541) for activating the tab for locking the ring. The ring (53) is provided with a continuous outer peripheral collar (5311), and the handling body (54) is provided with at least one raised element (5431) designed to abut (E4) against the continuous outer peripheral collar (5311) when the edge (541) activates the locking tab (537).

11 Claims, 8 Drawing Sheets

DEVICE FOR STOPPING A CONTAINER, AND CONTAINER PROVIDED WITH SUCH A DEVICE

CROSS-REFERENCE TO RELATED APPLICATIONS

This application is a section 371 of International Application No. PCT/EP2011/070609, filed Nov. 22, 2011, which was published in the French language on May 31, 2012 under International Publication No. WO 2012/069436 which claims the benefit of French Patent Application No. 1059683, filed Nov. 24, 2010, the disclosures of which are incorporated herein by reference.

BACKGROUND OF THE INVENTION

The invention relates to a device for stopping a container with a neck, as well as a container equipped with such a device.

With regards to containers for medication, a glass bottle is normally used to keep an active ingredient in the form of lyophilisat, in powder form or in a liquid solution. This type of bottle should be watertight to preserve the contents in a satisfactory condition, until its date of use. To hermetically seal a bottle, a device with an elastomer stopper is used which has a plastic cap placed around the stopping device to isolate the contents from the exterior.

WO-A-2007/063218 relates to a stopping device whose cap comprises a ring and a body allowing the locking means to manoeuvre the ring onto the neck of the container. It is also known as WO-A-2008/129144 for integrating a malleable component for transmission of a thrust force to a stopping device, this malleable component is destined to wear off when the thrust force has been effectively transmitted to lead a body into a position where it activates the locking means of a cap on the neck of a container. These known containers are completely satisfactory; in particular when they are used on bottles whose neck has a diameter of 20 mm.

When a stopping device has been led to a configuration where it activates its locking means, it is important that it remains on the neck of the container, without being moved other than in such a way as to clearly show that the contents of the bottle have been made accessible. This is necessary to avoid the risks of wrongful manipulation of the contents of the bottle.

It is this problem that the present invention deals with by proposing a stopping device which, when locking means are activated, is firmly held in position on the neck of a container, without any risk of untimely dismantling.

BRIEF SUMMARY OF THE INVENTION

To this effect, the invention concerns a device for stopping a container with a neck, this device comprises a stopper and a plastic cap, capable of surrounding both the stopper and the neck, the cap comprises a ring, which can surround the stopper and the neck in a raised position and has locking means on the neck, as well as a handling body for the ring provided with the first means for transmitting a thrust force to the ring and second means of activating the locking means of the ring with a thrust force and the second methods of activating the locking mechanism of the ring, this handling body surrounds the ring when it activates its locking means. This device is characterised in that the ring is provided with a continuous outer peripheral collar and the handling body is provided with at least one raised element designed to abut against the continuous outer peripheral collar when it activates the locking means.

Thanks to this invention, the cooperation between the peripheral collar, on the one hand, and the raised handling body, on the other hand, guarantees that the handling body is maintained in a position where it activates the locking means, at the point where these locking means remain effective to firmly immobilise the cap onto the neck of a container and prevent any wrongful access of the contents of the container.

According to the beneficial, but not mandatory, aspects of the invention, such a device can incorporate one or several of the following characteristics, taken in any technically admissible combination:

The raised handling body is formed using through an edge with an opening arranged through a peripheral partition of this body, this partition surrounding the ring when the handling body activates the locking means. We can anticipate that this opening abuts one part of the peripheral partition which is concave as seen from the exterior.

The locking means of the ring comprise locking tabs, which extend from an edge of this ring, towards the continuous outer peripheral collar.

The diameter of a circle passing by the external radial parts of the locking tabs has a greater external diameter of the edge from which these tabs extend.

The edge from which the locking tabs extend is continuous and each locking tab is used in an opening with a closed outline, which crosses the ring according to a radial direction in relation to the longitudinal and central axis of the ring.

The ring and the handling body are respectively provided with the first means of retaining and second methods of retaining which work together to hold the handling body in relation to the ring in a waiting position where it does not activate the locking means.

The first means of retaining the ring are arranged on the malleable bands which extend, in a parallel direction to the longitudinal and central axis of the ring, between the continuous outer peripheral collar and the annular edge of the ring from which the locking means extend.

The handling body comprises several raised sections aimed at simultaneously abutting against the continuous outer peripheral collar and are divided around a longitudinal and central axis of the handling body.

The maximum diameter of the continuous outer peripheral collar has a value greater than that of the diameter of an imaginary circle centered on the longitudinal and central axis of the handling body and crossing, on the inside, the raised parts.

The invention also relates to a container, especially a bottle for medications, equipped with a device for stopping such a container as mentioned above.

BRIEF DESCRIPTION OF THE SEVERAL VIEWS OF THE DRAWINGS

The invention will be better understood and other benefits of this will appear more clearly in light of the following description of a development method for a stopping device and of a container in compliance with its principle, given solely as an example, and with reference to the attached drawings in which.

DETAILED DESCRIPTION OF THE INVENTION

FIGS. 1 to 5 represent different stages of packaging a product P in glass bottles constituting the containers.

Figure 1:
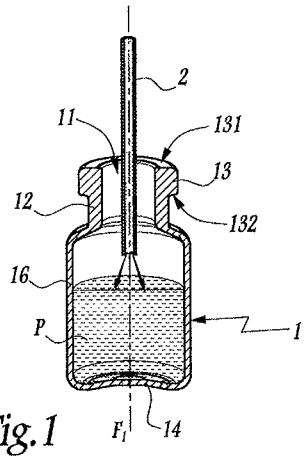
FIGS. 1 to 5 as shown in the diagram, an axial cross-section and a sectional perspective of FIGS. 1 and 2, several stages of packaging a product in containers which are in compliance with the invention.

In FIG. 1, bottle 1 is in the process of being filled with product P, for example, a medication. Pipette 2 is introduced into bottle 1 through its mouth 11 which is defined by a neck 12 presenting an outer collar 13. X1 shows the symmetrical axis of bottle 1.

When a predetermined quantity of product P has been introduced into bottle 1, pipette 2 is withdrawn and a stopping device, 50, is placed on neck 12.

The device 50, comprises an elastomeric stopper 51 adapted to be partially introduced into the mouth 11, while remaining on the side 131 of the collar 13 opposite the bottom 14 of the bottle 1. Once in place in the neck 12, the stopper 5 1 isolates the contents of the bottle 1 from the exterior.

The device 50 also comprises a cap 52 aimed at recovering and isolating the stopper 51 and the neck 12 in a closed configuration of the stopping device 50.

Figure 7:
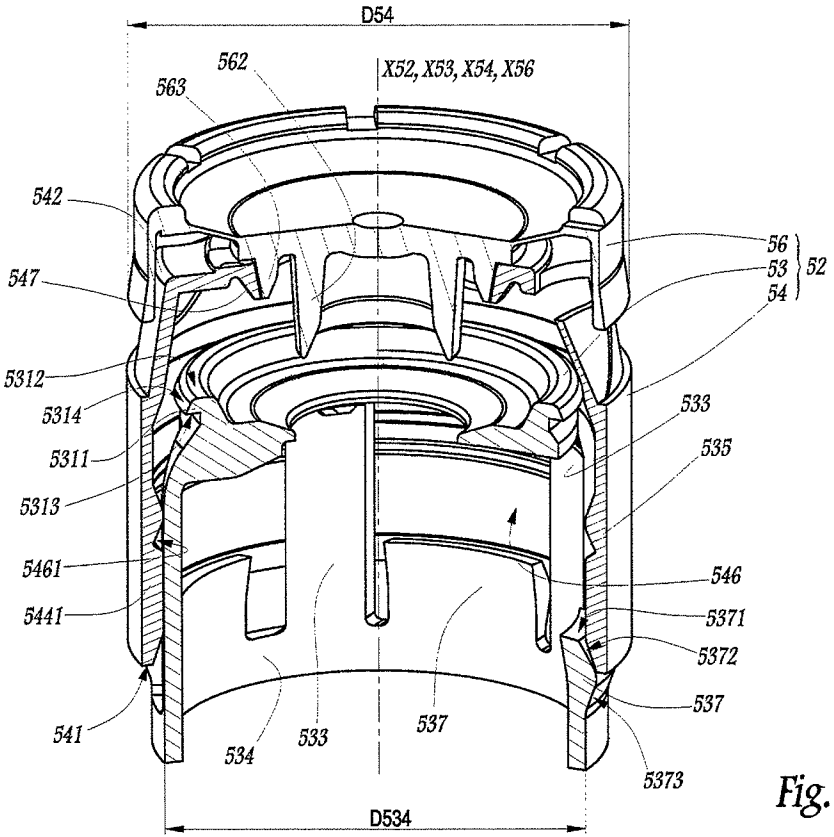
FIG. 7 is an axial cross-section and a much larger scale sectional perspective, of the cap of the devices for stopping containers in FIGS. 1 to 5, FIGS. 8 and 9 are fragmented perspectives, according to two different angles, of the cap in FIG. 7.
Figure 8:
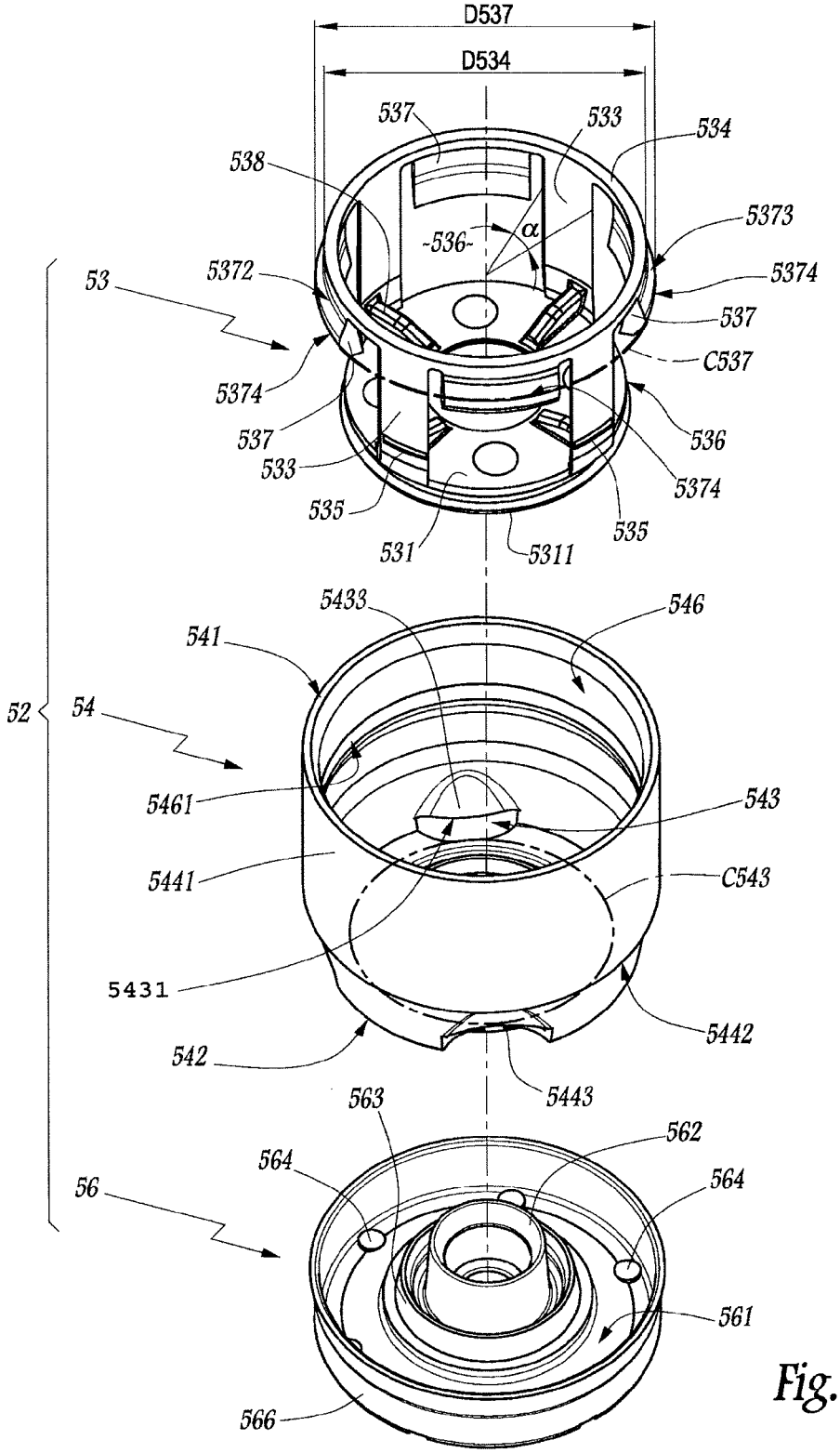
Figure 9:
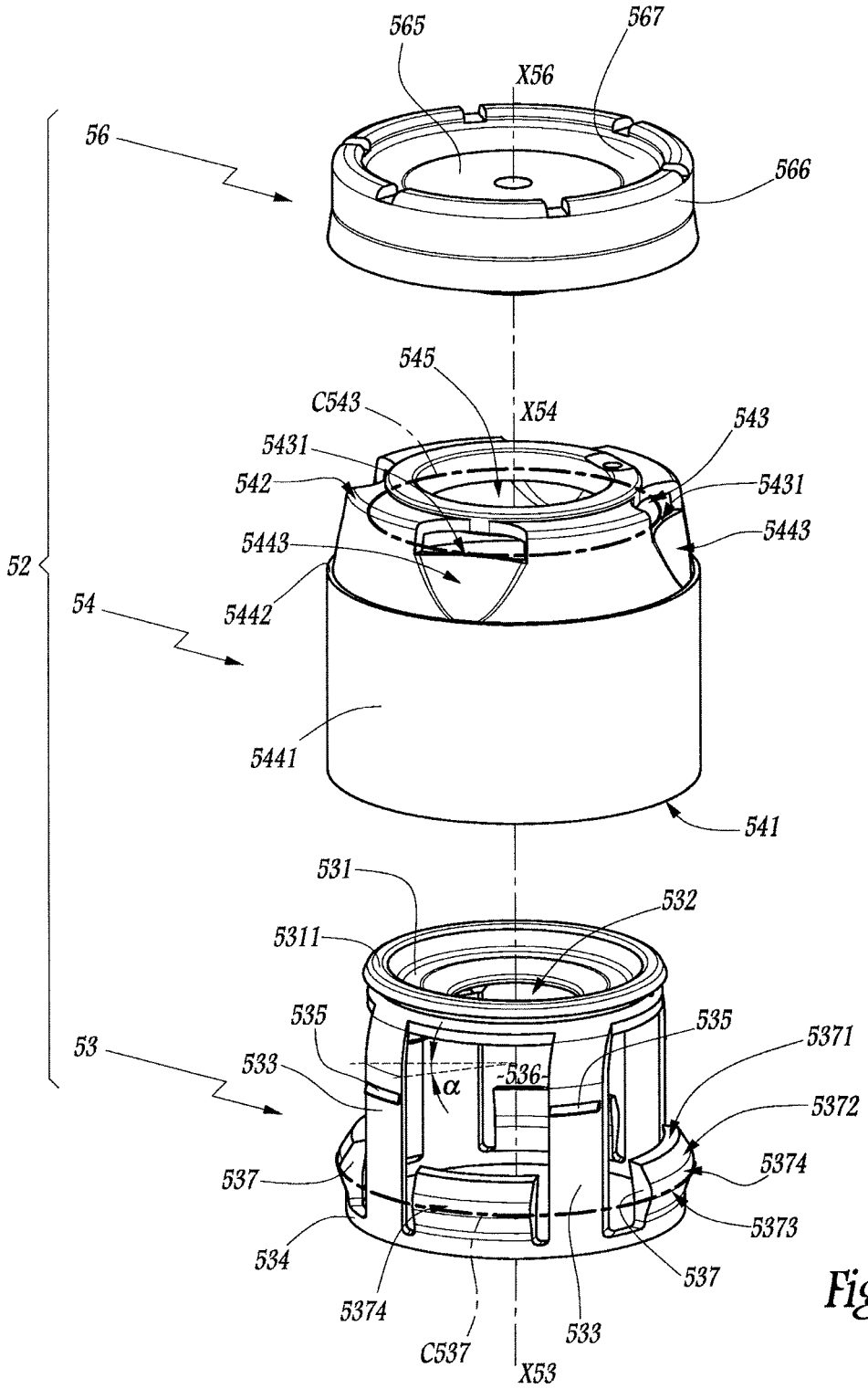

As shown most particularly in FIGS. 7 to 9, the cap 52 comprises a plastic ring 53, which is circular on the interior section and whose internal diameter is sufficient to allow it to surround the collar 13. The cap 52 also comprises a handling body for the ring 53, constituted by a plastic crown 54 which is intended to constitute the external peripheral envelope of the cap 52. The cap 52 further comprises a cover 56 also made of plastic. This cover 56 has complete rotational symmetry around a central axis X56.

541 shows the edge of the crown 54 which is oriented towards the bottle 1 in an installed configuration of the cap 52 on this bottle. This edge 541 can be qualified as <<inferior>> in as much as it is oriented towards the bottom in the configuration of FIGS. 2 to 5. In this description, the spatial orientation of the different elements mentioned is considered where a device 50 is mounted on a bottle 1 which rests on a flat surface by its base 14. One section is called <<lower>> when it is oriented towards the bottom in this configuration and <<higher>> when it is oriented towards the top.

542 shows the upper edge of the crown 54 which is opposed to the edge 541. This edge is cut into four openings 543 which cross a partition 544 in the form of a collar which makes up the section of the crown 54 which is intended to surround the ring 53 in a mounted configuration of the cap 52. In practice, the partition 544 comprises one cylindrical section 5441 with a circular section which extends between the edge 541 and a front face rib 5442. Between the edge 542 and the front face rib 5442, the partition 544 is provided with four zones 5443 which are concave seen from the exterior and which are each edged with an opening 543.

5431 shows the edge of an opening 543 which joins zone 5443. Each edge 5431 constitutes a raised section which extends from an area 5443 in direction of the axis X53.

The crown 54 also shows a central opening 545 centred on an axis X54, which is made up of a symmetrical axis for the crown 54, with the exception of its parts formed by the openings 543 and by the zones 5443. 547 shows the edge of opening 545.

The openings 543 have the same geometry and are regularly distributed around the axis X54, with an angular gap of 90°.

The ring 53 is centred on an axis X53 which is aligned with axis X54 and X56 in configuration with the cap 52, this axis being merged with a central axis X52 of the cap 52.

The ring 53 comprises an annular section 531 which defines a central opening 532 through which the upper surface 511 of the stopper 51 can be accessed where needed.

561 shows the internal surface of the cover 56, that is to say its surface turned towards the stopper 51 in a raised configuration of the device 50 on the bottle 1. The cover 56 has two collars 562 and 563 which are centred on the axis X56 and which extend parallel to this axis, each one from the surface 561. The collar 562 has an axial length, measured parallel to axis X56, greater than that of the collar 563.

During the manufacture of the cap 52, the cover 56 is placed on the crown 54 by closing the surface 561 of the edge 542, by introducing collars 562 and 563 in the opening 545 and in joining the cover 56 on the crown 54, next to the edge 542, by fusing several contacts 564 arranged for this reason on the surface 561 and equally divided around the collar 563. During this operation, the collar 563 is brought into contact with the edge 547.

The cover 56 is provided with a central rigid section 565 surrounded by a peripheral section 566, also rigid, so that a malleable net 567 connects parts 565 and 566.

When the cover 56 has been fixed onto the crown 54, the crown 54 is covered around the ring 53, in such a way that it delimits the maximum radial boundary of the cap 52, in relation to its central axis X52.

In practice, the geometry of ring 53, crown 54 and cover 56 is chosen in such a way that the maximum exterior diameter D54 of the crown 54 has a value less than 16.5 mm, preferably between 15.8 and 16.2 mm, preferably again being equal to 16 mm. In these conditions, when one uses a bottle 1 whose body 16 has a diameter equal to 16 mm, what is normal for certain medications, the cap 52 mounted onto bottle 1 does not exceed or slightly exceeds the body of bottle 1, according to a radial direction in relation to the axis X1. This allows the bottles 1, pre-equipped with stopping devices 50 to be juxtaposed on a shelf of a lyophilisator, with a high density, from a relatively small diameter of the bodies of these bottles, without there being any risk of the bottles being unbalanced by the stopping divides that they support.

The ring 53 comprises five bands 533 which extend from the section 531 to the lower edge of the ring 53 which is formed by a continuous edge 534 around the axis X53.

Section 531 comprises a continuous collar 5311, which extends peripherally and externally in relation to the rest of section 531 and which defines a second edge, or superior edge of the ring 53. The collar 5311 is shown between an upper surface 5312 oriented to the opposite of edge 534 and an inferior surface 5313 oriented towards the edge 534, each of these surfaces being perpendicular to the axis X53. The collar 5311 is edged, radially on the exterior, by a tapered surface 5314 which converges opposite the edge 534.

Each band 533 has an external rib 535 which stands out radially towards the exterior in relation to axis X53 in relation to this tab. Between each pair of two adjacent bands 533 is a window 536, or an open area at a fixed edge, connecting the interior volume of the ring 53 to the exterior.

A locking tab 537 extends from the edge 534 in each window 536. Taking into consideration the intrinsic suppleness of the material constituting the ring 53, each tab 537 can pivot, around its base, in relation to the edge 534. In other words, each tab 537 is in the form of a rib of a ribbed surface, centred on the axis X53 and converging in the direction of the edge 5371. Opposite the edge 5371, centred on the axis X53 and converging in the direction of the edge 534. Thus, the surface 5372 constitutes the outer peripheral upper surface of a tab 537, so that its surface 5373 constitutes an outer, inferior peripheral surface. The respective diameters of the surfaces 5372 and 5373 of a tab are chosen so that a semi-circular spout 5374 is formed at the junction between these surfaces. The spouts 5374 constitute the external radial parts of the tabs 537.

D534 shows the exterior diameter of the edge 534. D537 is the diameter of an imaginary circle C537 centred on the axis X53 and passing through the spouts 5374. In an unconstrained position of the locking tabs 537, the value of the diameter D537 is greater than that of the diameter D534, by at least 1.5 mm. Even when the crown 54 surrounds the locking tabs 537, as seen above, the diameter D537 has a greater value than diameter D534, the difference between these values thus being reduced.

On the interior of the junction between a band 533 and part 531, the ring 53 is provided with internal ribs 538 for superficially penetrating the stopper 51 to immobilise this stopper in the ring 53 and in the cap 52.

546 shows the internal radial surface of the partition 544. This surface is provided with a peripheral mouth 5461 which extends around the perimeter of the surface 546 and which is intended to receive the external ribs 535 of the ring 53 in a holding configuration represented in FIGS. 3 and 6. In this configuration, the crown 54 is mounted on the ring 53, without interacting with the locking tabs 537.

The configuration of FIG. 7 can be achieved by sliding the crown 54 around the ring 53 thanks to the preassembly force which is axial, that is to say, parallel to the axes X52, X53, X54 and X56 which are staggered. The effect of this is to lead the partition 544 around the bands 533 and this movement is continued until the external ribs 535 enter the peripheral mouth 5461 and are locked there. The sliding of the crown 54 in relation to the ring 53 takes place thanks to the elasticity of the bands 533 which can change their shape elastically when their respective ribs slide along the surface 546 of the crown 54 before joining at the peripheral mouth 5461. In other words, the geometry of the ring 53 gives the bands 533 sufficient suppleness so that the crown 54 can be easily set up around the ring 53. In practice, the bands 533 each extend, in relation to axis X53 onto an angular section of an angle at the top which is less than 30°, preferably at 25°, which gives them good elasticity.

Figure 2:
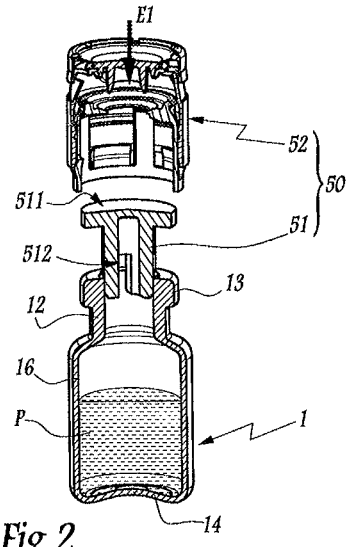
Figure 3:
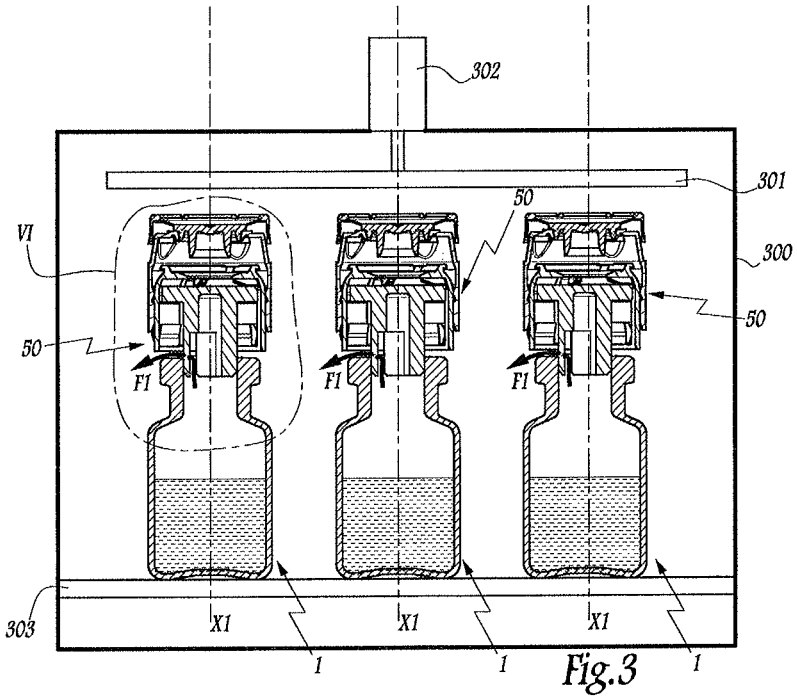

When the cap 52 has been thus pre-assembled, it is possible to place the stopper 51 here by introducing it to the interior of the ring 53, until the internal ribs 538 superficially penetrate the stopper 51, which will ensure that the position of the stopper in the ring is maintained. As a variant, the stopper 51 can be placed on the neck 12 of the bottle 1, as represented in FIG. 2, before the cap 52 is placed on the stopper thanks to an axial stress E 1. In all cases, the configuration of FIG. 3 is reached, where the stopper 51 does not completely fill the mouth 11 as this stopper is provided with a lateral cut 512 which communicates with a slot 200 at one part of the upper face 131 of the collar 13.

Figure 4:
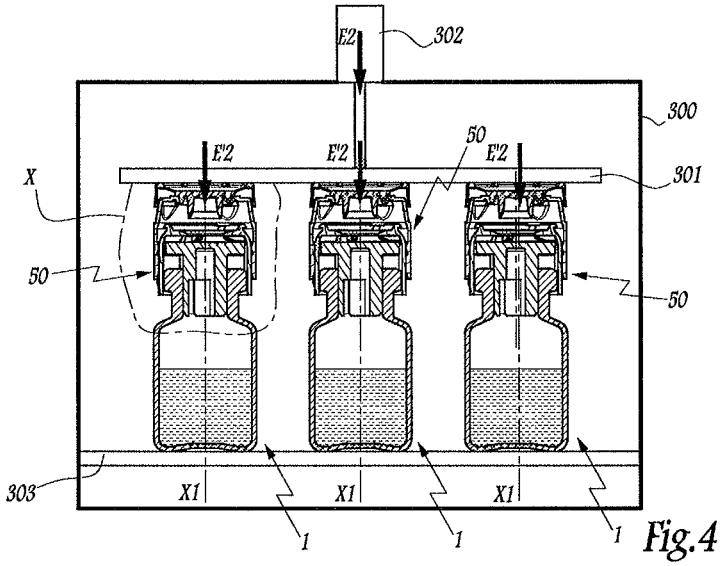
Figure 5:
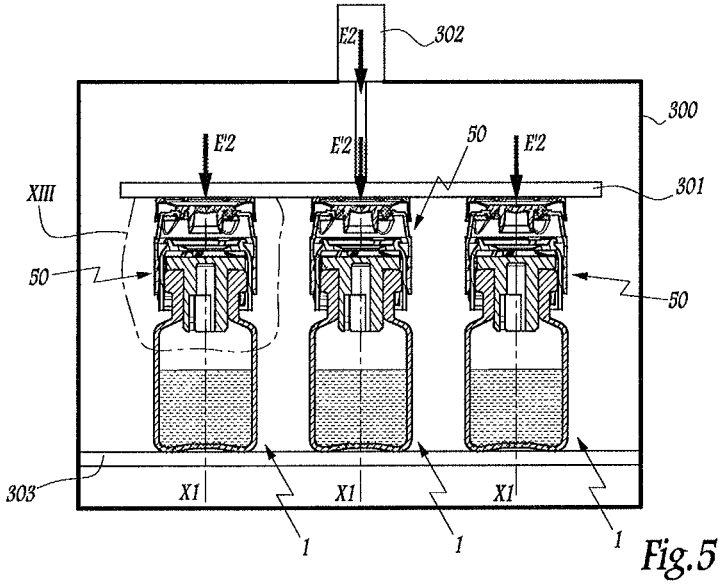

The bottle 1 equipped with the device 50 can therefore be introduced into a lyophiliser 300, in one lot of bottles 1. In FIGS. 3 to 5, three bottles represent one lot which can comprise several hundred, or even several million, bottles used in the lyophiliser 300. Moreover, the bottles can be used in this lyophiliser on several stacked shelves. In this lyophiliser, the water molecules present in each bottle 1 are moved towards the exterior, as represented by the arrows F1 in FIGS. 3 and 6, through the slots which remain between cap 52 and the collar 13.

Inside the lyophiliser, we can then, as represented in FIG. 4, push E2 on the devices 50 parallel to the longitudinal axis X1 of the bottles 1 and the necks 12, an axis with which is also joined the axes X52 of the different caps 52. This axial stress E2 is exerted by a mobile tray 301 inside the lyophiliser and controlled by a jack 302. The tray 301 at the same time sensitively exerts the same unitary stress R2 on the cap 52 of each bottle 1 of a row of bottles used at the same level, on the same tray 303 in the lyophiliser. The sum of the efforts E2 is equal to the effort E2.

Figure 10:
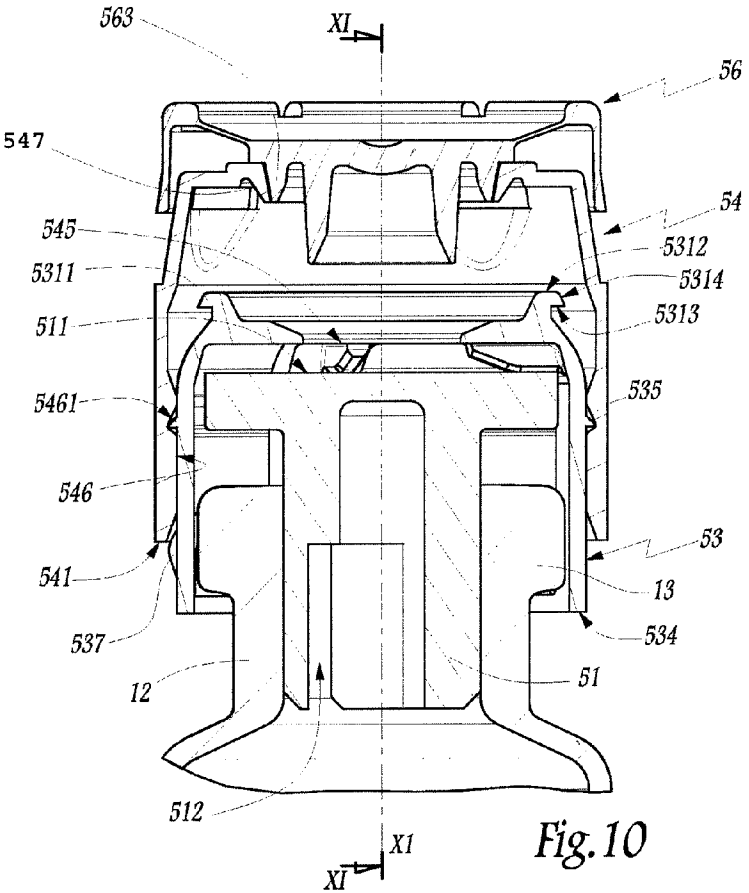
FIG. 10 is a larger scale view of the detail X in FIG. 4.

In the configuration in FIGS. 4 and 10, the crown 54 is in a second holding configuration where the external ribs 535 remain inserted in the peripheral mouth 5461. In this configuration, the crown does not interact with the locking tabs 537.

Figure 6:
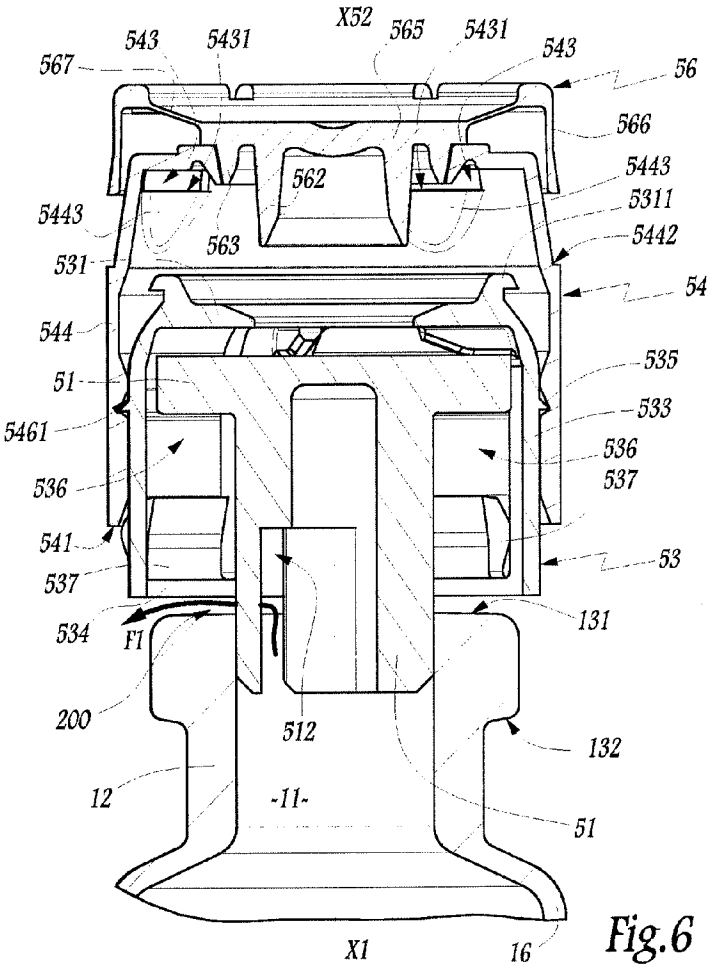
FIG. 6 is a large scale view of the detail V I in FIG. 3.

Applying stress E'2 has the effect of making the crown 54 of each cap 52 move in the direction of the bottom 14 of each of the bottles 1, as represented by the passage from the configuration in FIGS. 3 and 6 to that of FIGS. 4 and 10. The E'2 stress is transmitted from the crown 54 to the ring 53 through the intermediary of the peripheral mouth 5461 and the external ribs 535 which cooperate. Thus, external ribs 535 and the peripheral mouth 5461 constitute the stress transmission means E'2 from the crown 54 to the ring 53. The stress E'2 exerted on each device 50 has the effect of leading the tabs 537 of its ring 53 along the axis X1, between the collar 13 and the body 16 of the bottle around the part of the neck 12 which is not provided with a collar 13.

Figure 12:
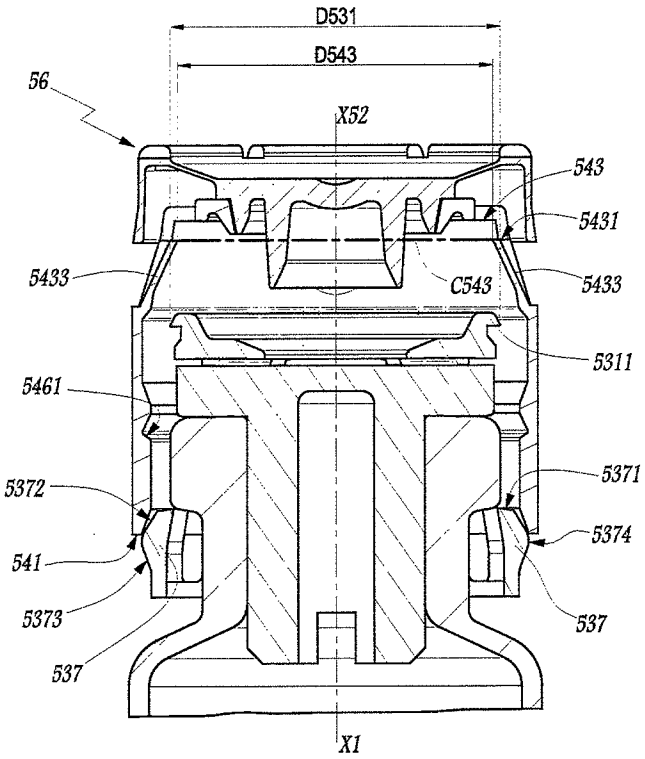
FIG. 12 is a cross section similar to FIG. 11 during an intermediary stage between the configurations of FIGS. 4 and 5.
Figure 11:
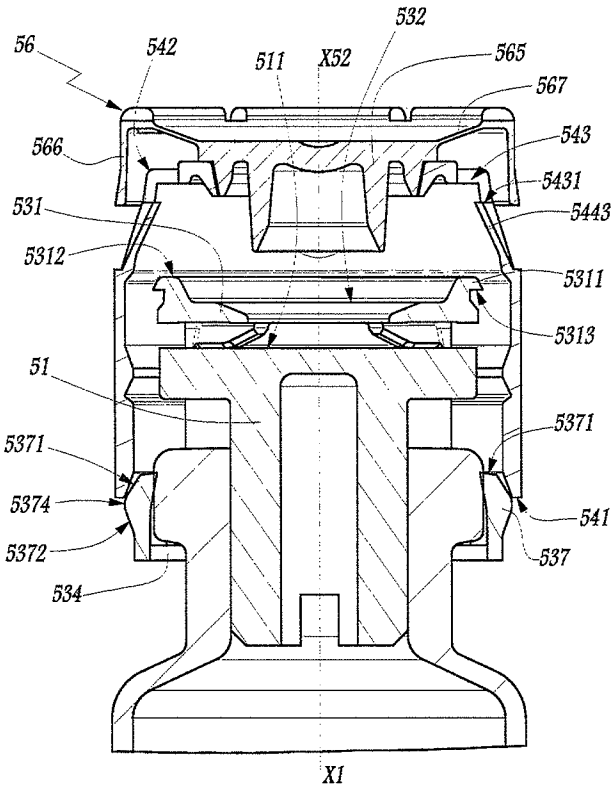
FIG. 11 is a cross section according to the line XI-XI in FIG. 10.
Figure 14:
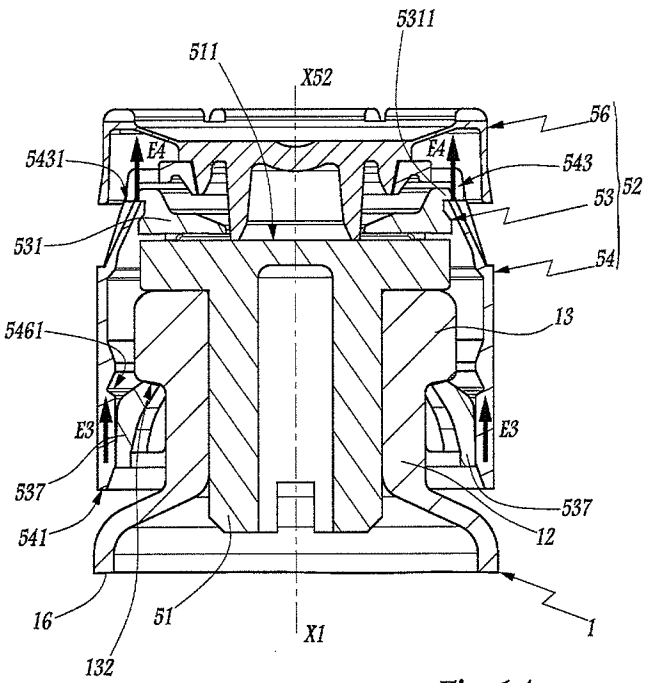
FIG. 14 is a cross section according to the line XIV-XIII of FIG. 13.

The annular section 531 thus makes contact with the upper surface 511 of the stopper 51 which halts the progression of the ring 53 in the direction of the base 14. The continued application of the stress E2 on the crown 54 of each device 50 has the effect of driving the external rib 535 of each band 533 to the exterior of the mouth 5461 by elastic deformation of the bands 533, which allows the crown 54 to successively attain the position of FIG. 12, then that of FIGS. 13 and 14. Firstly, this allows the edge 541 of the crown 54 to make contact with the surfaces 5372 of the different locking tabs 537, as represented in FIG. 12. The continuation of this movement has the effect of making the surfaces 5372 slide against the edge 541, which flaps the tabs 537 radially towards the axis X1, by moving their free side 5371 against the inferior peripheral surface 132 of the collar 13, as represented in FIG. 14. Thus, the edge 541 allows the locking tabs 537 to be put into an active configuration where they immobilise the cap 52 on the neck 12.

This movement also has the effect of causing the edges 5431 of the notches or openings 543 to abut against the surface 5313 of the collar 5311 which is oriented towards the edge 534. D531 shows the maximum diameter of the continuous outer peripheral collar 5311. This diameter is that of the edge of the junction between the surfaces 5313 and 5314. C543 shows an imaginary circle centred on an axis X54 and close, on the interior, to the edges 5431 of the notches or openings 543. When the zones 5443 of the partition 544 are not subject to any action by the collar 5311, the value of the diameter D543 is less than the value of the diameter D531. The zones 5443 are elastically deformed by sliding against the surface 5314, while passing from the configuration of FIG. 12 to the configuration of FIGS. 13 and 14. Finally, by elasticity, the parts of the partition 544 which make up zones 5443 have the tendency to fall back towards the axis X52, in such a way that the edges 5431 join below the continuous outer peripheral collar 5311.

If a withdrawal stress E3 of the crown 54 is exerted on this, as represented in FIG. 14, this effort is transmitted in the form of abutting E4 the sides 431 against the collar 5311 which opposes this and blocks the crown 54 in its position where it maintains the tabs 537 in configuration of entering the collar 13.

Figure 13:
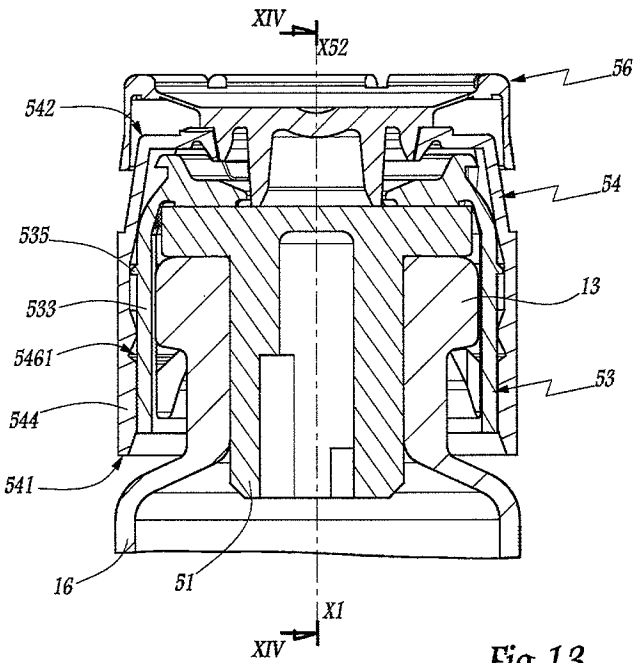
FIG. 13 is larger scale view of the detail XIII of FIG. 5

The result of this is a particularly effective locking of the crown 54 around the ring 53, in the configuration of FIGS. 13 and 14. Indeed, once the stopping device 50 is mounted on the neck 12 of a bottle 1, it is not possible to remove the crown 54 because the edges 5431 of the openings 543 are supporting the collar 5311 which is rigid and solid because of its continuous character around the axis X53. The only way to access the stopper 51, and through this, the contents of the bottle 1, is to take the cover 56 off by breaking the contacts 564.

In the configuration of FIGS. 13 and 14, the crown 54 is in its locking configuration in which it ensures, by the reinforcement that it exerts on the tabs 537, that these tabs are held in a configuration which is connected to the surface 132 of the collar 13. The crown 54 therefore constitutes a handling body of the ring 53, this handling body activates the locking means constituted by the tabs 537. The ring 53, crown 54 and cover 56 are each compact and can be moulded into polyoxymethylene (POM) or into an equivalent material.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. Device for stopping a container (1) with a neck (12), the device comprising:

a stopper (51); and a plastic cap (52) configured to surround both the stopper and the neck, the cap comprising:

a ring (53) configured to surround the stopper and the neck when mounted and provided with a means (537) for locking the ring onto the neck, and a handling body (54) for handling the ring provided with a first means (535) for transmitting a thrust force (E2) to the ring and a second means (541) for activating the means for locking the ring (537), the handling body surrounding the ring when the second means activates the means for locking, characterised in that the ring (53) is provided with a continuous outer peripheral collar (5311) and in that the handling body (54) is provided with at least one raised edge (5431) designed to abut (E4) against the continuous outer peripheral collar (5311) when the second means activates the means (537) for locking.

2. Device according to claim 1, characterised by a raised handling body is formed by the raised edge (5431) of an opening (543) inserted through a peripheral barrier (544) of the handling body (54) which surrounds the ring (53) when the second means of the handling body activates the means (537) for locking.

3. Device according to claim 2, characterised by the opening (543) bordering a part (5443) of the peripheral barrier (544) which is concave when seen from the exterior of the handling body (54).

4. Device according to claim 1, characterised by the means for locking of the ring (53) comprising locking tabs (537) which extend, from a raised edge (534) of the ring, in the direction of the continuous outer peripheral collar (5311).

5. Device according to claim 4, characterised by the diameter (D537) of a circle (C537) passing through external radial sections (5374) of the locking tabs (537) at a greater value than the external diameter (D534) of the raised edge (534) from which the locking tabs extend.

6. Device according to claim 4, characterised by the raised edge (534) from which the locking tabs extend (537) is continuous and each locking tab is arranged in an opening (536) with a closed outline which crosses the ring (53) according to a radial direction in relation to a longitudinal and central axis (X53) of the ring.

7. Device according to claim 1, characterised by the ring (53) and the handling body (54) which are respectively provided with a first means of retaining (533) and a second means of retaining (5461) which work together to maintain the handling body in relation to the ring in a waiting position where it does not activate the means (537) for locking.

8. Device according to claim 6, characterised by a first means of retaining (533) the ring (53) are arranged in malleable bands (533) which extend, according to a parallel direction to the longitudinal and central axis (X53) of the ring, between the continuous outer peripheral collar (5311) and the raised edge (534) of the ring from which the means (537) for locking extend.

9. Device according to claim 1, characterised in that the handling body (54) comprises several dimensions (5431) which simultaneously abut against the continuous outer peripheral collar (5311) and are distributed around a longitudinal and central axis (X54) of the handling body.

10. Device according to claim 9, characterised by the maximum diameter (D531) of the continuous outer peripheral collar (5311) with a value greater than that of the diameter (D543) of an imaginary circle (C543) centred on the longitudinal and central axis (X54) of the handling body (54) and tangential to the interior, with the several dimensions (5431).

11. Container (1) equipped with the device (50) according to claim 1.

* * * * *